US008072315B2

(12) United States Patent
Lin

(10) Patent No.: US 8,072,315 B2
(45) Date of Patent: Dec. 6, 2011

(54) METHOD AND APPARATUS FOR UNIVERSALLY DECODING COMMANDS OF A REMOTE CONTROLLER

(75) Inventor: Sheng-Feng Lin, Hsinchu County (TW)

(73) Assignee: MStar Semiconductor, Inc., ChuPei, Hsin-Chu Hsien (TW)

( * ) Notice: Subject to any disclaimer, the term of this patent is extended or adjusted under 35 U.S.C. 154(b) by 1066 days.

(21) Appl. No.: 11/469,873

(22) Filed: Sep. 3, 2006

(65) Prior Publication Data

US 2007/0290880 A1 Dec. 20, 2007

(30) Foreign Application Priority Data

Jun. 7, 2006 (TW) ..... 95120189 A

(51) Int. Cl.
*G08B 21/00* (2006.01)

(52) U.S. Cl. ..... 340/12.5; 340/12.17; 340/12.22; 340/12.23; 341/176; 348/734; 398/106

(58) Field of Classification Search ..... 340/5.22, 340/825.22, 825.65, 825.69, 825.72; 341/176; 398/106; 348/734
See application file for complete search history.

(56) References Cited

U.S. PATENT DOCUMENTS 4,626,848 A * 12/1986 Ehlers ..... 340/825.69
4,999,622 A * 3/1991 Amano et al. ..... 340/825.72
5,142,398 A * 8/1992 Heep ..... 398/112
5,506,715 A * 4/1996 Zhu ..... 398/111
5,691,710 A * 11/1997 Pietraszak et al. ..... 340/825.72
5,819,294 A * 10/1998 Chambers ..... 1/1
6,097,309 A * 8/2000 Hayes et al. ..... 340/825.69
6,097,520 A * 8/2000 Kadnier ..... 398/106
7,046,964 B1 5/2006 Sullivan
7,062,175 B2 * 6/2006 Stevenson et al. ..... 398/115
2004/0004552 A1 * 1/2004 Yang et al. ..... 340/825.69

FOREIGN PATENT DOCUMENTS

TW I235000 6/2005
TW I244834 12/2005
TW I246026 12/2005

OTHER PUBLICATIONS

Data Sheet, MOS Integrated Circuit μPD6121, 6122, NEC Corporation, 1994, p. 1-27.
http://www2.renesas.com/faq/en/mi_com/f_com_remo.html, Renesas Electronics Corporation, Apr. 2006.

* cited by examiner

*Primary Examiner* — Jennifer Mehmood
*Assistant Examiner* — Mark Rushing
(74) *Attorney, Agent, or Firm* — Winston Hsu; Scott Margo

(57) ABSTRACT

A universal decoding device and associated method is provided. The universal decoding device includes a counter unit for counting signal cycles and a logic unit for identifying coded data or commands according to counted signal cycles. The logic unit includes a register, an boundary logic unit, a key identification unit, a code bank, a multiplexer, and a FIFO memory. The universal decoding device is capable of operating in a full decoding mode, a raw data decoding mode, and a software decoding mode. In the full decoding mode, the FIFO stores remote control commands corresponding to the counted signal cycles through the multiplexer. In the raw data decoding mode, the FIFO stores raw data corresponding to the counted signal cycles through the multiplexer. In the software decoding mode, the FIFO stores the counted signal cycles provided by the counter unit through the multiplexer.

22 Claims, 8 Drawing Sheets

METHOD AND APPARATUS FOR UNIVERSALLY DECODING COMMANDS OF A REMOTE CONTROLLER

BACKGROUND OF THE INVENTION

1. Field of the Invention

The present invention relates to remote control systems, and more particularly, to a method capable of universally decoding remote control commands and associated apparatus.

2. Description of the Prior Art

As electronics technology progresses, all kinds of electronic devices are steadily becoming a part of everyday life in a modern society. Many consumer electronics products, such as televisions, DVD players, and multi-function digital media players are being adopted generally by society. In order to allow a user to operate each function of every consumer electronics product, most of the consumer electronics products come with a remote controller. The remote controller allows the user to control operation of any electronic product.

The prior art infrared control system allows one-to-one control of the electronic device. In other words, every electronic device must have its own corresponding remote control. And, each function that the remote controller operates is governed by a remote control signal that contains information associated with the function. The remote controller has many buttons, each of which controls one of the functions. To engage one of the functions of the electronic device, the user must press the corresponding button to send the remote control signal containing the information associated with that function. When the electronic device receives the remote control signal, the electronic device extracts the information from the remote control signal, and performs the function corresponding to the information in the remote control signal.

Generally speaking, the remote controller employs either infrared or radio frequency technology for transmission. Radio frequency technology does not have a problem of dependence upon transmission direction, and is also bi-directional, such that it not only sends remote control signals, but is also able to receive signals, such as status information, from other appliances, and display the same on a display of the remote control. Infrared technology, on the other hand, has advantages of a smaller size, lower power consumption and low cost. Thus, remote controllers that employ infrared technology dominate a remote control market.

FIG. 1 is a diagram of an infrared remote control system 10 according to the prior art. The infrared remote control system 10 comprises a transmitting end 12 and a receiving end 14. The transmitting end 12 comprises an input interface 120, an encoding module 122, and an infrared transmitter 126. The receiving end 14 comprises an infrared receiver 140, a control module 144, and a functions module 146. At the transmitting end 12, the input interface 120 comprises a plurality of buttons corresponding to different functions, and a user can press the buttons to perform functions of the electronic device. The encoding module 122 converts an output of the input interface 120 to a binary signal, which may include a header or padding bits, according to a predetermined rule, in order to produce a packet complying with a special format. The packet is then transmitted to the receiving end 14 through an infrared beam by the infrared transmitter 126. Contrastingly, at the receiving end 14, the infrared receiver 140 converts the infrared beam from the infrared transmitter 126 to an electronic signal through an optical-to-electrical conversion process. The control module 144 comprises a microcontroller 148 and a memory 150 for demodulating, decoding, and recognizing the control signal sent by the transmitting end 12. The control module 144 downconverts the control signal carried by the infrared beam to a baseband, in order to recognize a control command from the transmitting end 12, and execute corresponding functions F(1) . . . F(n) through the functions module 146 based on the control command.

In the infrared remote control system 10, because only a small amount of information is transmitted from the transmitting end 12 to the receiving end 14, accuracy is the most important consideration when transmitting the information. Many encoding standards have been developed in the prior art. In Europe, two most prevalent standard encoding schemes are an RC-5 standard and an RECS80 standard. In Asia, an NEC standard is prevalent. Besides, many consumer electronics manufacturers, such as Mitsubishi, Panasonic, and JVC, develop proprietary encoding schemes. These encoding schemes can be roughly divided into three modulation methods: phase modulation, pulse width modulation, and pulse position modulation. Please refer to FIGS. 2-4, which are waveforms corresponding to phase modulation, pulse width modulation, and pulse position modulation, respectively. Phase modulation represents a falling edge within a unit time interval by a "0", and a rising edge within the unit time interval by a "1". In pulse width modulation (shown in FIG. 3), pulse width determines a "0" and a "1". For example, in an NEC encoding standard, the "0" represents a pulse that is high for 0.56 ms and low for 0.56 ms, and the "1" represents a pulse that is high for 0.56 ms and low for 1.68 ms. Finally, pulse position modulation (shown in FIG. 4) represents pulses occurring in different positions relative to a reference pulse position by "0" and "1".

In view of the above modulation methods, the control module 144 requires different demodulation and decoding methods to obtain the control command sent by the transmitting end 12. Taking the pulse width modulation as an example, the microcontroller 148 of the control module 144 uses an internal clock to measure a high period and a low period to identify the "0" and "1" of the received signal. In other words, a decoding process according to the prior art requires the internal clock of the microcontroller 148. Generally speaking, in multimedia devices, in addition to demodulation and decoding, the microcontroller 148 also involves video and audio processing. Thus, the prior art occupies the internal clock hardware resource of the microcontroller 148, which decreases the efficiency of the video and audio processing performed by the microcontroller 144, and deteriorates the multimedia output quality. In view of the above decoding standards, the prior art remote control system use proprietary hardware to realize one of the decoding standards. No flexibility exists in design for system manufacturers. For example, liquid crystal display (LCD) televisions require an infrared receiver, but LCD televisions are sold all over the world. Thus, infrared systems with proprietary decoding schemes are troublesome for various modifications for system manufacturers.

SUMMARY OF THE INVENTION

The present invention discloses a method of universally decoding a remote control command, comprising receiving a remote control signal, counting a plurality of numbers of signal cycles traversing between adjacent edges in the remote control signal, and identifying a plurality of coded data based on the numbers of signal cycles.

The present invention further discloses a universal decoding apparatus, comprising a counter unit for receiving a remote control signal and counting a plurality of numbers of signal cycles traversing between two adjacent edges in the remote control signal, and a logic unit for identifying a plurality of coded data corresponding to the numbers of signal cycles.

These and other objectives of the present invention will no doubt become obvious to those of ordinary skill in the art after reading the following detailed description of the preferred embodiment that is illustrated in the various figures and drawings.

DETAILED DESCRIPTION

Figure 5:
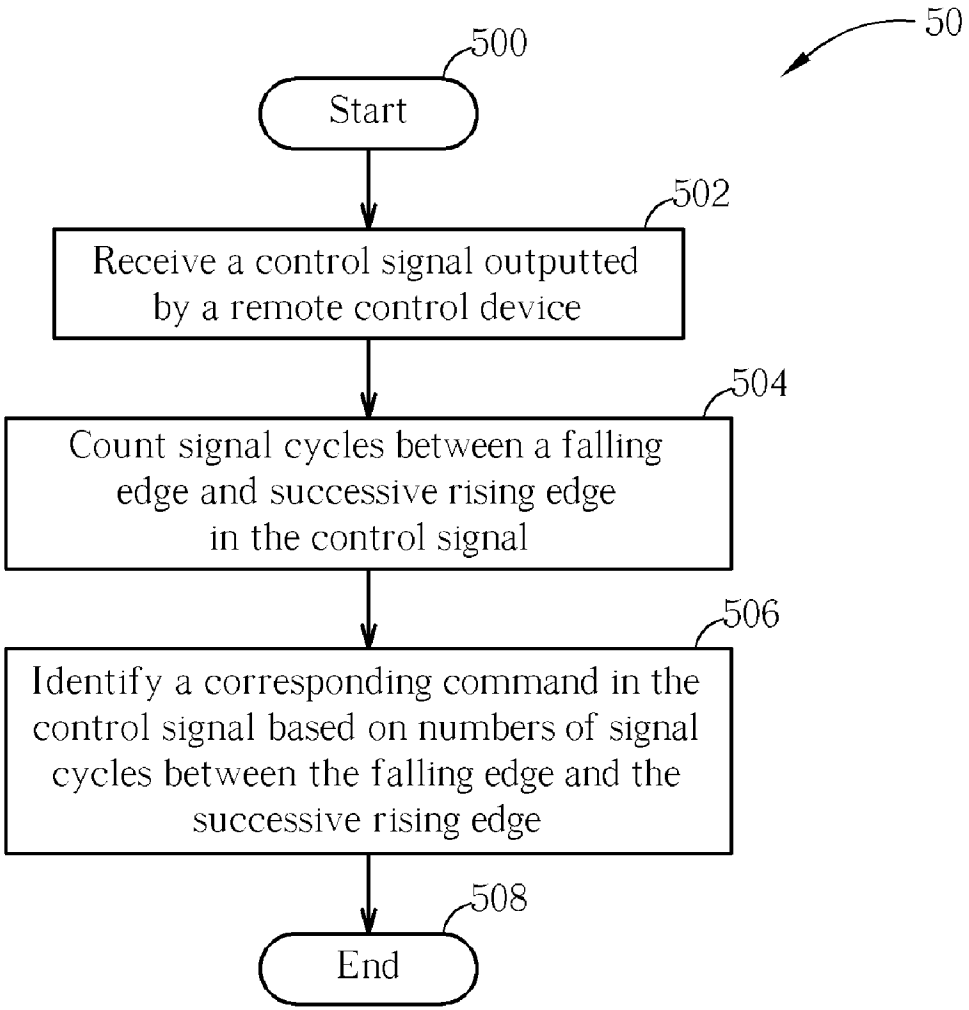
FIG. 5 is a flow chart of a method of identifying a command of a remote control device according to the present invention.

Please refer to FIG. 5, which is a flow chart 50 of a method of identifying a remote control command according to one embodiment of the present invention, comprising steps of:

Step 500: Start.

Step 502: Receive a control signal outputted by a remote control device.

Step 504: Count signal cycles between a falling edge and a successive rising edge in the control signal.

Step 506: Identify a corresponding command in the control signal based on the numbers of signal cycles between each falling edge and the successive rising edge.

Step 508: End.

The present invention method identifies a corresponding command in a remote control infrared signal based on a number of signal cycles between a falling edge and a successive rising edge of the remote control signal. Taking pulse width modulation (shown in FIG. 3) as an example, pulse width modulation (PWM) uses a ratio of high and low portions of the control signal to determine "0" and "1". For example, in an NEC PWM standard, if 1 microsecond (us) is taken as a measuring cycle unit, "0" comprises a 0.56 ms high pulse followed by a 0.56 ms low, and "1" comprises a 0.56 ms high pulse followed by a 1.68 ms low. Thus, when the number of signal cycles between the falling edge and the immediately successive rising edge is 560 (0.56 ms/1 us), a corresponding bit is determined as "0". When the number of signal cycles between the falling edge and the immediately successive rising edge is 1680 (1.68 ms/1 us), then the corresponding bit is determined as "1". Preferably, identifying corresponding bits of the control signal is based on the number of signal cycles traversing between the falling edge of the control signal and the immediately successive rising edge of the control signal. After obtaining all bits from the control signal, the command of the control signal can be identified. Preferably, "0" and "1" signals are determined based on a low level portion of the control signal, by counting the number of signal cycles traversing between the falling edge and the immediately successive rising edge. Alternatively, if "0" and "1" of the PWM control signal are distinguished by different length intervals at a high level while keeping low level portions of the signal at a constant length, then identification can be performed by counting the number of signal cycles that pass between a rising edge of the control signal and an immediate successive falling edge of the control signal. Alternatively, the high level portions and the low level portions can be inverted according to a designer's preference.

In order to identify the commands of the control signal based on the number of signal cycles, a plurality of predetermined commands can be set first. Each predetermined command corresponds to a predetermined signal cycle number combination. Then, after determining a signal cycle number combination from the numbers of signal cycles traversing between each falling edge and its immediately successive rising edge in the control signal, the signal cycle number combination can be compared with the predetermined signal cycle number combinations to determine if the signal cycle number combination matches one of the predetermined signal cycle number combinations. If so, the command corresponding to the control signal can be identified as the command corresponding to the predetermined signal cycle number combination. In other words, after counting the number of signal cycles traversing between each falling edge and its successive rising edge in the control signal, the command outputted by the remote control device can be identified based on the signal cycle number combination.

In order to avoid noise and electromagnetic interference, when identifying the bit based on the number of signal cycles, a first threshold and a second threshold can be set. When the number of signal cycles is greater than a difference between a first value and the first threshold and is less than a sum of the first value and the second threshold, then the number of signal cycles is identified as the first value. The first threshold and the second threshold can be set in an internal hardware register of the remote control device, which provides good flexibility. The first threshold and the second threshold can even be set to a same value by a single register. In this way, if the control signal encounters noise interference, the corresponding command can still be identified correctly. It should be noted that the infrared signals transmitted and received by household appliances are exposed to an environment that is filled with interference, and that the infrared signal transmission is easily influenced by noise. Thus, making the first value adjustable is very beneficial to accurate and sensitive identification of the commands of the control signal.

Figure 6:
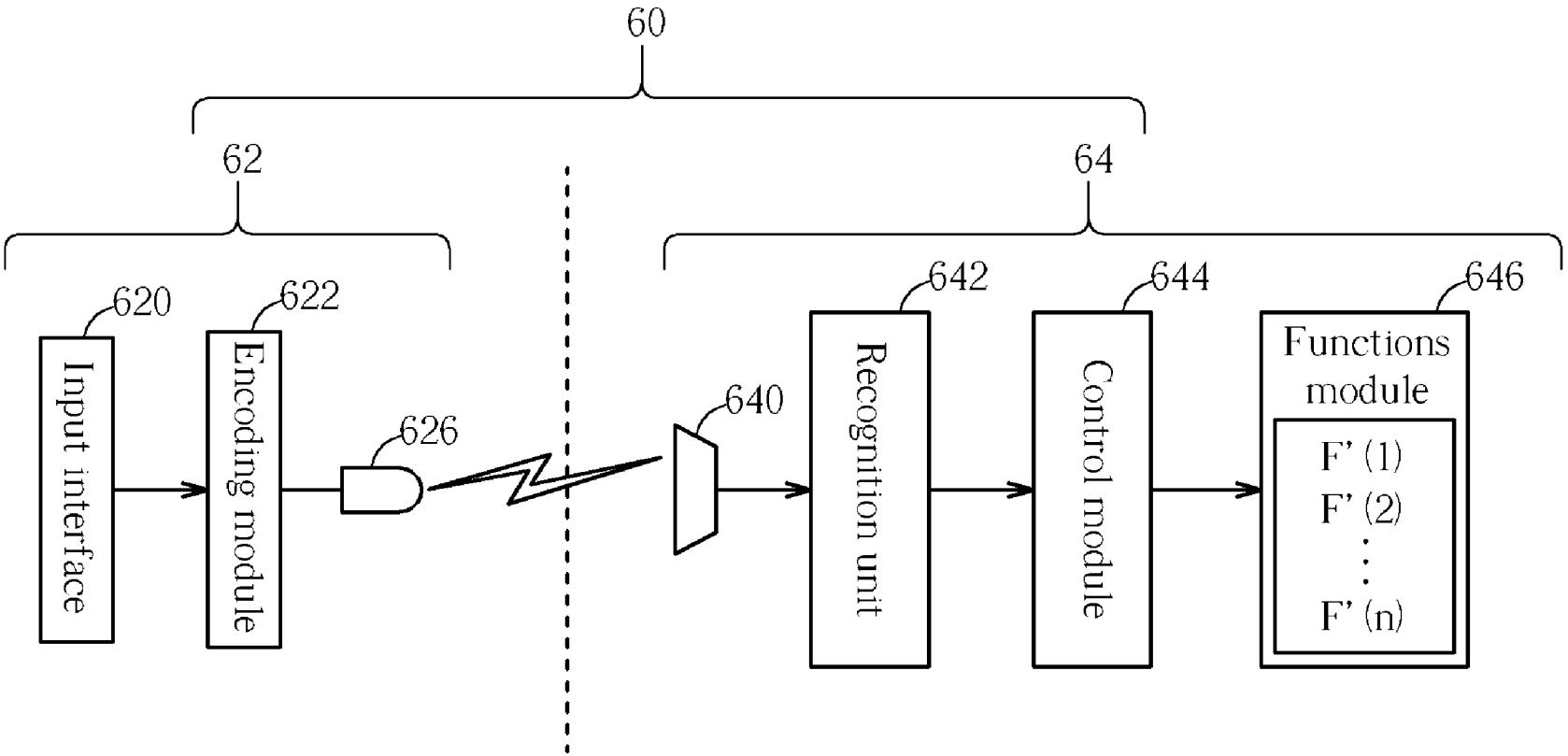
FIG. 6 shows a block diagram of an infrared remote control system according to the present invention.

FIG. 6 shows a block diagram of an infrared remote control system 60 according to one embodiment of the present invention, comprising an transmitting end 62 and a receiving end 64. The transmitting end 62 comprises an input interface 620, an encoding module 622, and an infrared transmitter 626. The receiving end 64 comprises an infrared receiver 640, a recognition unit 642, a control module 644, and a functions module 646. At the transmitting end 62, the input interface 620 comprises a plurality of buttons corresponding to different functions. A user presses the buttons of the input interface 620 to actuate different functions of the electronic device. The encoding module 622 transforms a signal outputted by the input interface 620 to a digital signal with a header and padding bits based on a predetermined principle to comply with a specific packet format, and use the infrared transmitter 626 to transmit the digital signal by an infrared beam to the receiving end 64. On the other hand, at the receiving end 64, the infrared receiver 640 performs opto-electronic conversion on the infrared signal received from the infrared transmitter 626 to convert the infrared signal to an electronic signal. The recognition unit 642 then performs the flow chart 50 described above to identify a command carried by the signal outputted by the transmitting end 62. The control module 644 commands the functions module 646 based on the identification result of the recognition unit 642 to perform a corresponding function of F'(1) . . . F'(n).

Figure 1:
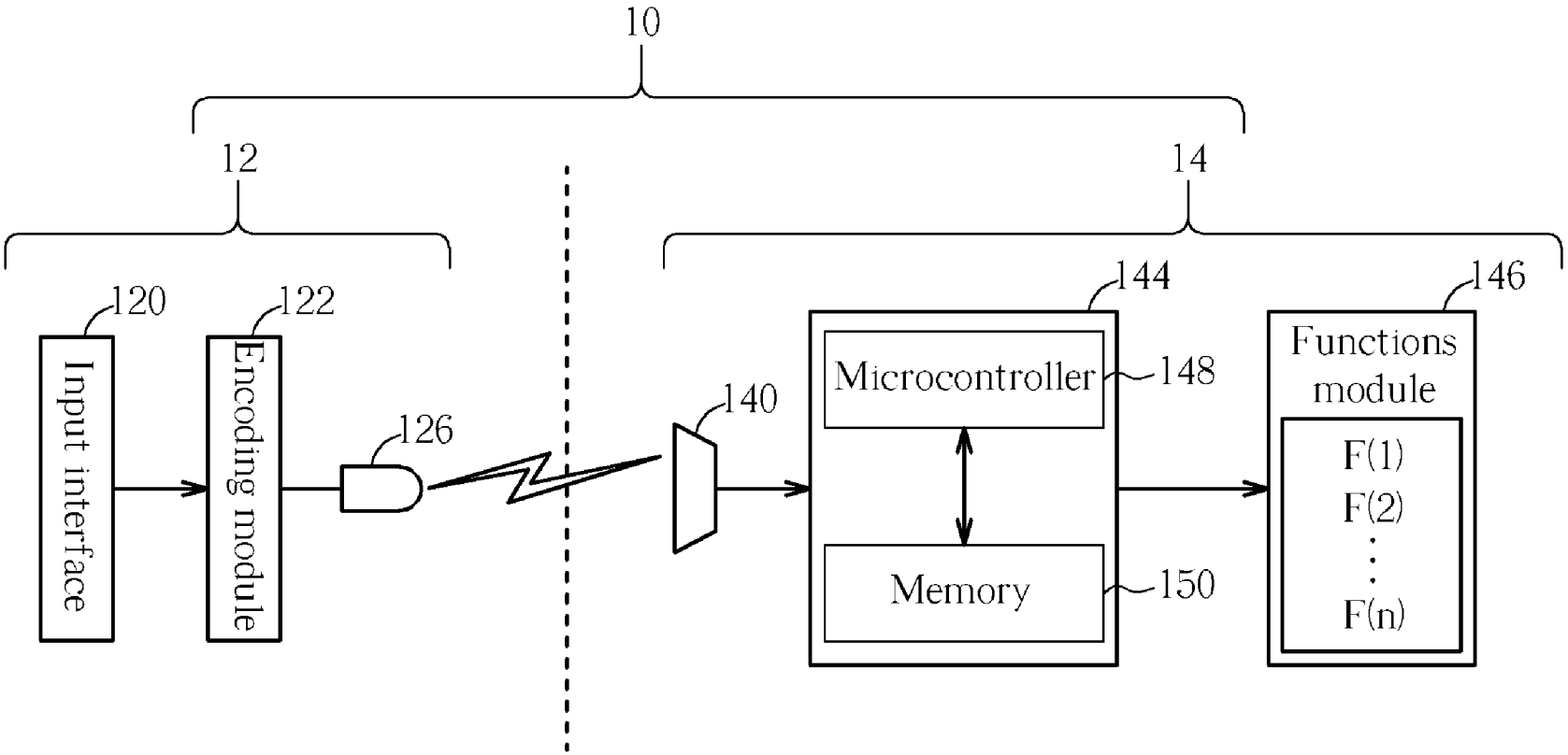
Fig. 1 Prior art
FIG. 1 shows an infrared remote control system according to the prior art.
Figure 2:
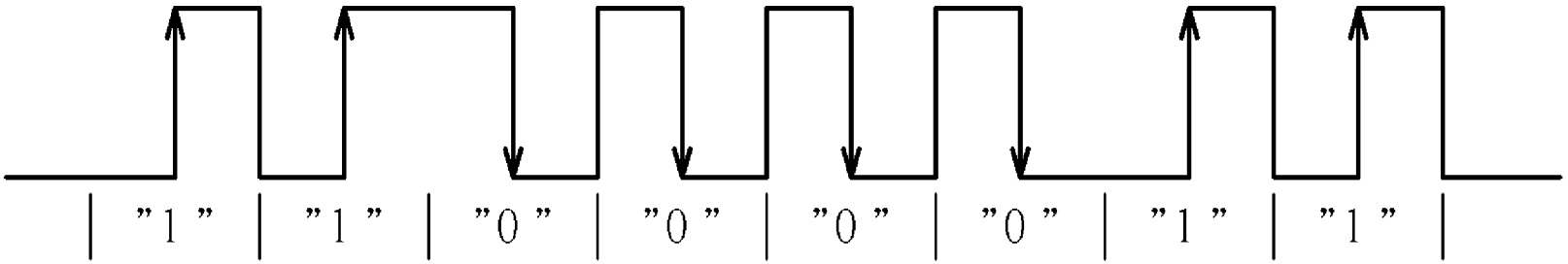
Fig. 2 Prior art
FIG. 2 is a diagram of a phase modulated waveform.
Figure 3:
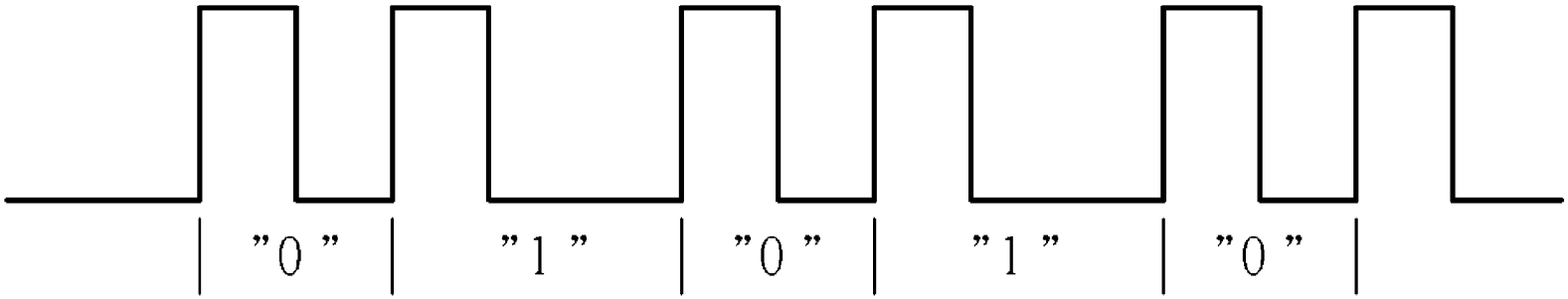
Fig. 3 Prior art
FIG. 3 is a diagram of a pulse width modulated waveform.
Figure 4:
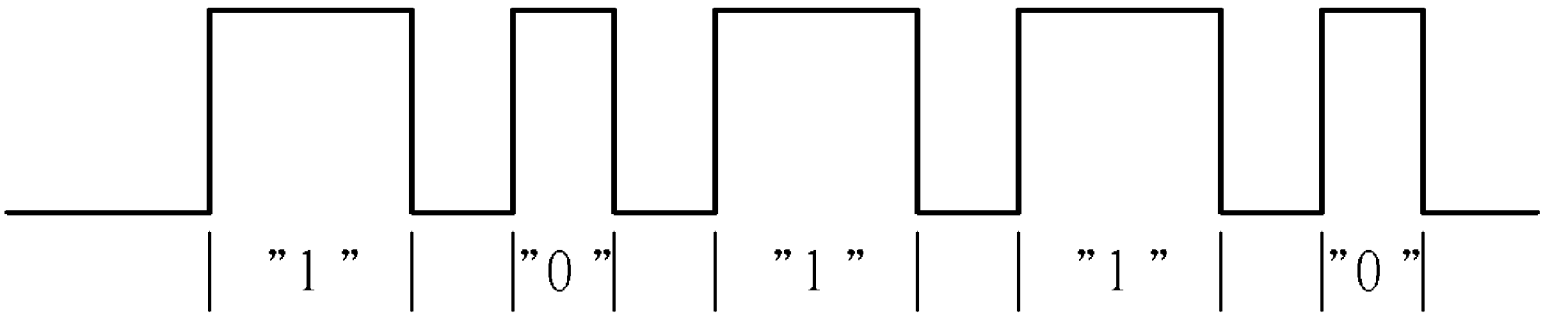
Fig. 4 Prior art
FIG. 4 is a diagram of a pulse position modulated waveform.
Figure 7:
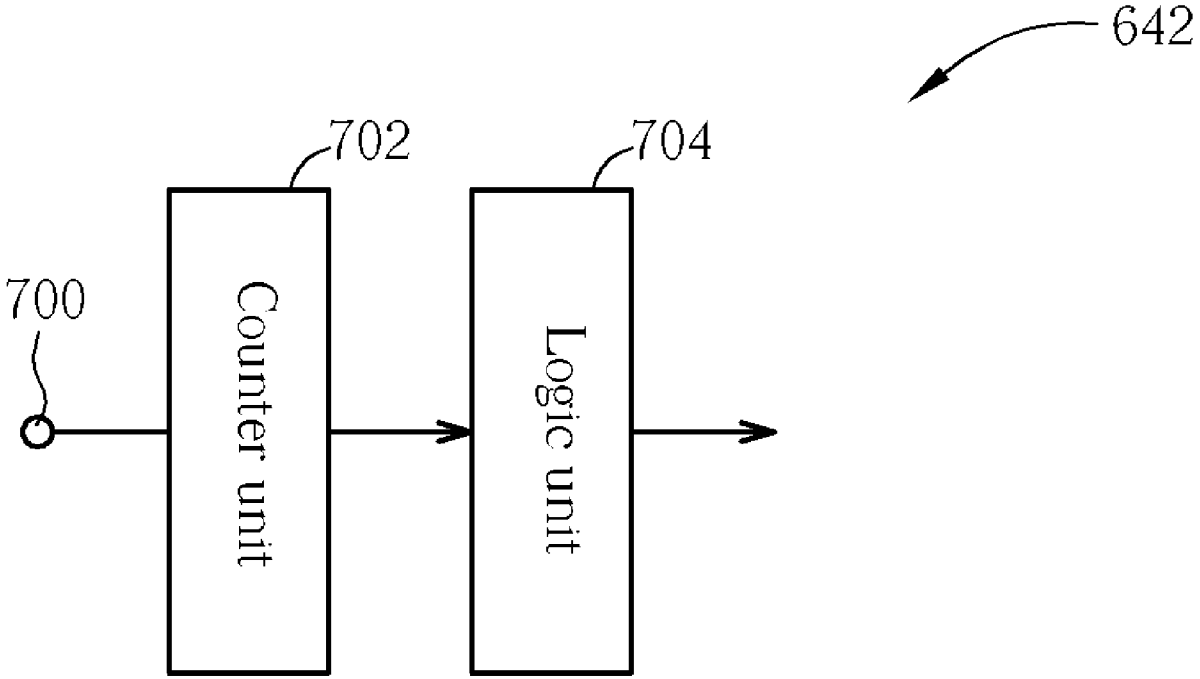
FIG. 7 shows a block diagram of an identification unit according to the present invention.

FIG. 7 shows a block diagram of the recognition unit 642 according to one embodiment of the present invention, comprising a receiving terminal 700, a counter unit 702, and a logic unit 704. The receiving terminal 700 is used to receive the control signal outputted by the transmitting end 62 through the infrared receiver 640. The counter unit 702 counts a plurality of numbers of signal cycles traversing between each falling edge and an immediately successive rising edge of the control signal. The logic unit 704 identifies a command of the control signal based on a counting result of the counter unit 702. The recognition unit 642 identifies the command of the control signal by counting the number of signal cycles traversing between the falling edge and the immediately successive rising edge of the control signal. Taking a PWM modulation as an example, as shown in FIG. 3, PWM uses a ratio of high and low portions of the control signal to determine "0" and "1". For example, in an NEC PWM standard, assume that 1 microsecond (us) is utilized as a measuring cycle unit for the control signal, "0" comprises a 0.56 ms high pulse followed by a 0.56 ms low, and "1" comprises a 0.56 ms high pulse followed by a 1.68 ms low. Thus, when the counting unit 702 counts 560 signal cycles (0.56 ms/1 us) after the falling edge, the logic unit 704 will identify the current bit as "0". When the counting unit 702 counts 1680 signal cycles (1.68 ms/1 us) after the falling edge, the logic unit 704 will identify the current bit as "1" bit. In other words, the recognition unit 642 identifies the bits based on the numbers of signal cycles traversing between each falling edge and the immediately successive rising edge of the control signal. After identifying all of the bits in the control signal, the logic unit 704 can further identify the corresponding command of the control signal. It should be noted that when the PWM modulation scheme uses a low level portion of the signal to identify the "0" and "1" bits, the counter unit 702 will count the numbers of signal cycles traversing between each falling edge and the immediately successive rising edge of the control signals to identify the bits of the control signal. On the other hand, if the PWM modulation scheme uses a high level portion of the signal to identify the "0" and "1" bits, the counter unit 702 will count the numbers of signal cycles traversing between each rising edge and an immediately successive falling edge to identify the bits of the control signal. One of normal skill in the art could make various modifications corresponding to different modulation schemes in view of the above disclosure. For example, the number of signal cycles traversing between the falling edge and the rising edge (either immediately following or immediately preceding the falling edge) can be counted to identify the bits.

Preferably, for the recognition unit 642, a noise reduction unit (not shown) can be further disposed between the infrared receiver 640 and the receiving terminal 700 for suppressing electromagnetic glitch interference in the control signal.

In the recognition unit 642, the logic unit 704 identifies the bits from the result of the counter unit 702. The logic unit 704 could be realized by a microprocessor and program codes (not shown in FIG. 6) in the control module 644, or the logic unit 704 could be realized as an independent circuit or firmware. Please refer to FIG. 8, which shows a block diagram of the logic unit 704 according to one embodiment of the present invention. The logic unit 704 comprises a boundary logic detector 800, a register 802, a key identification unit 804, a code bank 806, and a first-in-first-out (FIFO) memory 808. The register 802 stores a first threshold and a second threshold. According to the first threshold and the second threshold, when the number of signal cycles counted by the counter unit 702 is greater than a difference of a first value and the first threshold and less than a sum of the first value and the second threshold, the boundary logic detector 800 determines the number of signal cycles as the first value, and thus outputs correct coded logic data accordingly. The control signal can still be accurately identified when seriously interfered by noise. The code bank 806 stores a plurality of decoded data. When a combination of the numbers of signal cycles obtained from the boundary logic detector 800 is substantially equal to a predetermined combination of numbers of signal cycles, the key identification unit 804 can identify the control signal as decoded data or a command corresponding to the predetermined combination of numbers of signal cycles. The FIFO memory 808 stores the decoded data or command outputted by the code bank 806, then transmit the command to the control module 644 in a first-in-first-out manner to perform the corresponding function. After the counter unit 702 counts the numbers of signal cycles traversing between each falling edge and the immediately successive rising edge of the control signal, the boundary logic detector 800 can determine if the boundary is reasonable with a programmable flexibility, by utilizing the first threshold and the second threshold, and output coded data accordingly. Based on the combination of the numbers of signal cycles, the key identification unit 804 can identify the coded data or command represented by the control signal outputted by the remote control device. The key identification unit 804 is preferably realized by a state machine. For example, because each signal received has a header, the key identification unit 804 will first determine if the header of the signal is correct before performing identification of the coded data. The identification sends the coded data to the code bank through a first signal path 816. The key identification unit 804 could also read coded data from the code bank 806 through a second signal path 817, perform further identification of the command according to the coded data, and again store the command to the code bank 806 through the first signal path 816. Then, after storing the command in the FIFO memory 808, the command is sent to the control module 644 for further processing. The control module 644 is preferably a microprocessor, such as an 8051 microprocessor.

Figure 8:
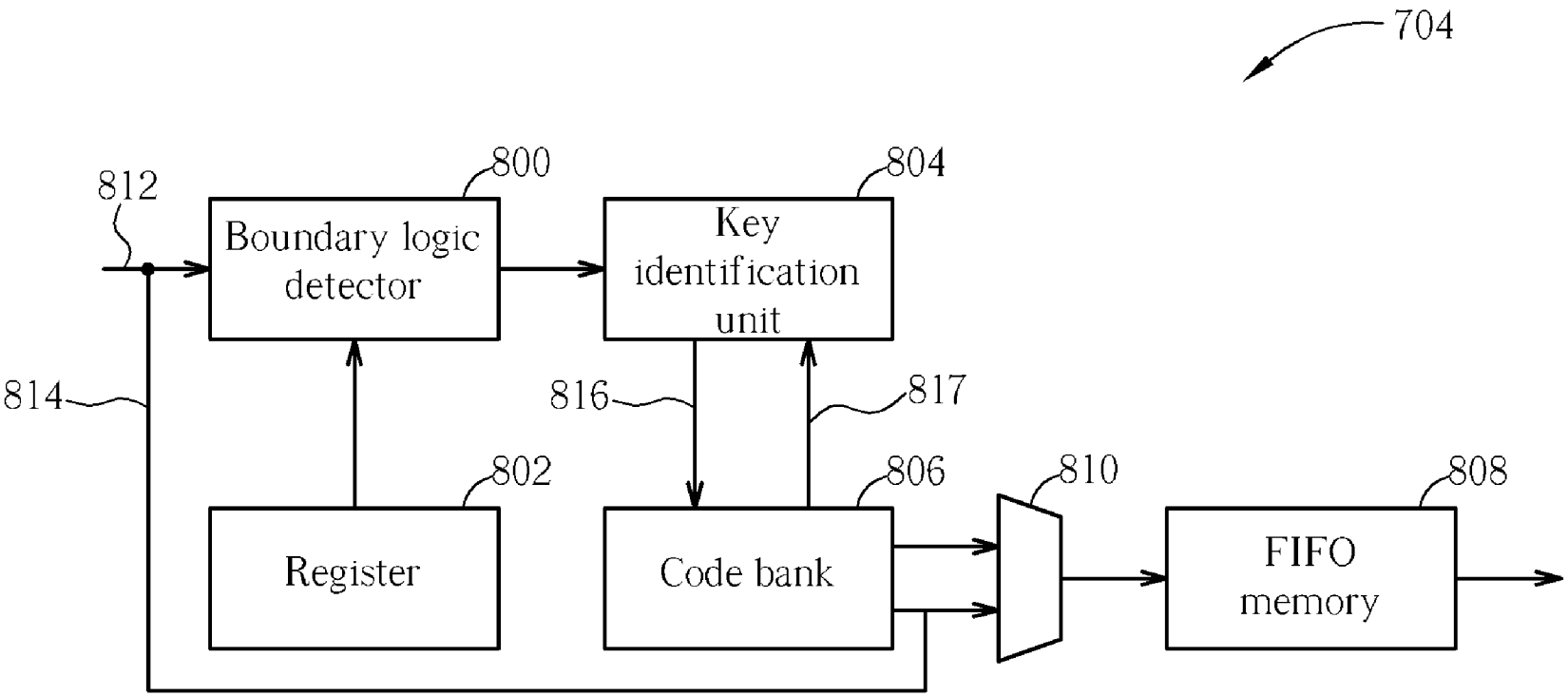
FIG. 8 shows a block diagram of a logic unit according to the present invention.

In addition, as shown in FIG. 8, the FIFO memory 808 can also directly store a counting result (or raw data) from the counter unit 702. In this embodiment, the result from the counter unit 702 comes through a signal 812, and can be stored to FIFO memory 808 through a signal 814 and a multiplexer 810. Then, an interrupt is issued to the microprocessor to read the raw data from the FIFO memory 808 to perform decoding. Thus, no internal clock resource of the microprocessor is occupied for decoding PWM. In other words, the counting result of the counter unit 702 can bypass processing by the boundary logic detector 800, the key identification unit 804, and the code bank 806, and instead be sent directly to the control module 644 through the FIFO memory 808, so as to meet special application requirements, such as non-PWM modulation schemes. Thus, the present invention can be used in various types of remote control systems. System integrators can flexibly design different decoding schemes corresponding to different infrared remote control systems. The system integrator, such as an LCD television manufacturer, can apply the infrared remote control system according to the present invention to flexibly realize various decoding schemes, and thereby save manufacturing time and cost.

Based on the hardware structure shown in FIG. 8, three decoding modes can be supported, including a full decode mode, a raw data mode, and a software decode mode. In the full decode mode, the key identification unit 804 stores the coded data to the code bank 806 through the first signal path 816. Then, the key identification unit 804 reads the coded data back from the code bank 806 through the second signal path 817. The command is identified based on the coded data, then the command is stored in the code bank 806 through the first signal path 816. Thus, the command represented by the signal can be fully resolved and stored in the code bank 806. An interrupt invokes the microprocessor to read the command. In the raw data mode, the key identification unit 804 stores the coded data to the code bank 806 through the first signal path 816, then directly interrupts the microprocessor to read the coded data for further processing. In the software decode mode, the counting result from the counter unit 702 is stored directly in the FIFO memory 808 by routing the result through the signal path 814 and the multiplexer 810, and an interrupt is issued to the microprocessor to read the result for further processing. Thus, the present invention provides system integrators with design flexibility to develop universal receivers and achieve universal decoding.

To sum up, the present invention counts a plurality of numbers of signal cycles between two neighboring transitions in a control signal received from a remote control device. For example, the present invention could count a plurality of numbers of signal cycles between each falling edge and an immediately following rising edge of the control signal. Then, the present invention identifies a command corresponding to the control signal. According to the present invention, an internal clock of a microprocessor used for counting duration of high and/or low levels in the control signal is reduced, thereby improving efficiency, and increasing output quality. In addition of utilize a hardware circuit to identify coded keys or commands, the present invention can also decode commands by process raw data using the microprocessor, so as to provide maximum flexibility for different infrared remote control system requirements, thus allowing the system manufacturers to develop universal remote control receivers and save manufacturing time and costs.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of universally decoding a remote control command comprising:

receiving a remote control signal;

counting a plurality of numbers of signal cycles traversing between each falling edge and its immediately successive rising edge among a plurality of adjacent edges in the remote control signal, wherein for each pair of adjacent edges in the remote control signal, a number of signal cycles from a first edge to a second edge in the pair of adjacent edges is counted, and coded data is generated based on the counting result;

comparing coded data of the remote control signal to a plurality of predetermined commands stored in advance before the remote control signal is received, the predetermined commands corresponding to a plurality of infrared remote protocols; and universally identifying the remote control command represented by the remote control signal according to the comparison of the coded data of the remote control signal and the predetermined commands according to the numbers of signal cycles in the remote control signal.

2. The method of claim 1 further comprising suppressing electromagnetic glitch interference in the remote control signal.

3. The method of claim 1, wherein said identifying step substantially identifies one of the numbers of signal cycles as a logic coded data corresponding to the first value when the number of signal cycles is greater than a difference of the first value and a first threshold value and the number of signal cycles is less than a sum of the first value and a second threshold.

4. The method of claim 3, wherein the first threshold is substantially equal to the second threshold.

5. The method of claim 1 further comprising executing a function corresponding to the identified remote control command represented by the remote control signal.

6. A universal decoding apparatus used in a universal remote control receiver comprising:

a counter unit for receiving a remote control signal and counting a plurality of numbers of signal cycles traversing between each falling edge and its immediately successive rising edge among a plurality of adjacent edges in the remote control signal, wherein for each pair of adjacent edges in the remote control signal, a number of signal cycles from a first edge to a second edge in the pair of adjacent edges is counted;

a memory for storing predetermined commands in advance before the remote control signal is received by the universal remote control receiver; and a logic unit for universally identifying a plurality of coded data for a plurality of infrared remote protocols according to the numbers of signal cycles in the remote control signal based on a comparison of the coded data to the predetermined commands stored in the memory.

7. The universal decoding apparatus of claim 6 further comprising a noise suppression unit coupled to a front end of the counter unit for suppressing an electromagnetic glitch interference in the remote control signal.

8. The universal decoding apparatus of claim 6, wherein the logic unit comprises:

a key identification unit for identifying the coded data based on the numbers of signal cycles; and a code bank coupled to the key identification unit for storing the coded data.

9. The universal decoding apparatus of claim 8, wherein the key identification unit identifies a remote control command represented by the remote control signal based on a combination of the coded data.

10. The universal decoding apparatus of claim 6, wherein the logic unit comprises:

a register for storing and setting a first threshold and a second threshold; and a boundary logic detector coupled to the register for identifying one of the numbers of signal cycles as a logic coded data corresponding to a first value when the number signal cycles is greater than a difference between the first value and the first threshold and less than a sum of the first value and the second threshold.

11. The universal decoding apparatus of claim 10, wherein the first threshold is substantially equal to the second threshold.

12. The universal decoding apparatus of claim 6 further comprising a first-in-first-out (FIFO) memory for storing the coded data and the counter unit can issue an interrupt to the microprocessor for reading the coded data.

13. The universal decoding apparatus of claim 6, wherein the logic unit comprises:

a register for storing a first threshold and a second threshold;

a boundary logic detector coupled to the register for identifying one of the numbers of signal cycles as a logic coded data corresponding to a first value when the number of signal cycles is greater than a difference between the first value and the first threshold and less than a sum of the first value and the second threshold;

a key identification unit coupled to the boundary logic detector for identifying the coded data; and a code bank coupled to the key identification unit for storing the coded data.

14. The universal decoding apparatus of claim 13, wherein the identification unit identifies a command represented by the remote control signal based on a combination of the plurality of coded data, and stores the command in the code bank.

15. The universal decoding apparatus of claim 14 further comprising a first-in-first-out (FIFO) memory coupled to the code bank for storing the coded data and the counter unit can issue an interrupt to the microprocessor for reading the coded data.

16. The universal decoding apparatus of claim 13 further comprising:

a multiplexer coupled to the code bank and the counter unit; and a first-in-first-out (FIFO) memory coupled to the multiplexer.

17. The universal decoding apparatus of claim 16, wherein the universal decoding apparatus can operate in a full decode mode, a raw data mode, and a software decode mode.

18. The universal decoding apparatus of claim 17, wherein when operating in the full decode mode, the FIFO memory stores a command based on the numbers of signal cycles through the multiplexer.

19. The universal decoding apparatus of claim 17, wherein when operating in the raw data mode, the FIFO memory stores raw data based on the numbers of signal cycles through the multiplexer.

20. The universal decoding apparatus of claim 17, wherein when operating in the software decode mode, the FIFO memory directly stores the numbers of signal cycles from the counter unit through the multiplexer.

21. The universal decoding apparatus of claim 6 further comprising a function module for executing a function corresponding to the identified coded data associated with the remote control signal.

22. The universal decoding apparatus of claim 6 being fabricated on a single silicon.

* * * * *